US012145191B2

(12) United States Patent
Sato et al.

(10) Patent No.: US 12,145,191 B2
(45) Date of Patent: Nov. 19, 2024

(54) BENDING SYSTEM AND TOOL TRANSPORT METHOD

(71) Applicant: AMADA CO., LTD., Kanagawa (JP)

(72) Inventors: Masaaki Sato, Kanagawa (JP); Yohei Yamaguchi, Kanagawa (JP)

(73) Assignee: AMADA CO., LTD., Kanagawa (JP)

( * ) Notice: Subject to any disclaimer, the term of this patent is extended or adjusted under 35 U.S.C. 154(b) by 590 days.

(21) Appl. No.: 17/610,484

(22) PCT Filed: May 8, 2020

(86) PCT No.: PCT/JP2020/018708

§ 371 (c)(1),
(2) Date: Nov. 11, 2021

(87) PCT Pub. No.: WO2020/230730

PCT Pub. Date: Nov. 19, 2020

(65) Prior Publication Data

US 2022/0219221 A1 Jul. 14, 2022

(30) Foreign Application Priority Data

May 16, 2019 (JP) ..... 2019-092890

(51) Int. Cl.
*B21D 5/02* (2006.01)
*B23Q 3/155* (2006.01)

(52) U.S. Cl.
CPC ..... *B21D 5/0254* (2013.01); *Y10T 483/10* (2015.01); *Y10T 483/1731* (2015.01)

(58) Field of Classification Search
CPC ..... Y10T 483/1729; Y10T 483/1731; Y10T 483/10; B21D 5/0254; B21D 37/145
USPC ..... 483/28–29, 1
See application file for complete search history.

(56) References Cited

U.S. PATENT DOCUMENTS

| | | | | |
|---|---|---|---|---|
| 9,975,161 | B2 * | 5/2018 | Sato | B21D 5/0254 |
| 12,036,599 | B2 * | 7/2024 | Sato | B21D 5/0254 |
| 2003/0092547 | A1 | 5/2003 | Akami et al. | |
| 2004/0157715 | A1 | 8/2004 | Akami et al. | |
| 2014/0326036 | A1 | 11/2014 | Hayashi | |

(Continued)

FOREIGN PATENT DOCUMENTS

| | | |
|---|---|---|
| EP | 1 160 024 A1 | 12/2001 |
| JP | 1672868 | 4/2011 |

(Continued)

OTHER PUBLICATIONS

Extended European Search Report for corresponding EP Application No. 20804835.5 dated Jun. 14, 2022.

(Continued)

*Primary Examiner* — Erica E Cadugan
(74) *Attorney, Agent, or Firm* — Renner, Otto, Boisselle & Sklar, LLP

(57) ABSTRACT

A first tool retention member of a first tool exchange unit retains a first tool to be exchanged in a state of being engaged in an engagement hole of the first tool. A second tool retention member of a second tool exchange unit retains a second tool not to be exchanged in a state of being engaged in an engagement hole of the second tool. Subsequently, the first tool exchange unit moves in a left-right direction in a state in which a movement of the second tool exchange unit in the left-right direction is stopped.

6 Claims, 8 Drawing Sheets

(56) References Cited

U.S. PATENT DOCUMENTS

| | | | | |
|---|---|---|---|---|
| 2017/0297073 | A1 | 10/2017 | Sato | |
| 2022/0203429 | A1* | 6/2022 | Sato | B21D 5/02 |
| 2024/0024942 | A1* | 1/2024 | Hattori | B21D 5/0254 |

FOREIGN PATENT DOCUMENTS

| | | | |
|---|---|---|---|
| JP | 5841800 | | 1/2016 |
| JP | 5947861 | B2 | 7/2016 |
| JP | 2023-041024 | A * | 3/2023 |

OTHER PUBLICATIONS

International Search Report for corresponding Application No. PCT/JP2020/018708, mailed Jun. 30, 2020.
Written Opinion for corresponding Application No. PCT/JP2020/018708, mailed Jun. 30, 2020.

* cited by examiner

BENDING SYSTEM AND TOOL TRANSPORT METHOD

TECHNICAL FIELD

The present invention relates to a bending system for bending a plate-shaped workpiece by using an automatically exchangeable tool, and a tool transport method for transporting the tool along a tool holder of a press brake or a selected stocker.

BACKGROUND ART

Patent Literature 1 proposes a bending system placed on a lateral side of a press brake and provided with a tool storage for storing a plurality of tools. The tool storage includes a plurality of stockers for retaining the plurality of tools. Each stocker extends in a left-right direction. Any selected stocker is configured to be able to be positioned at an exchange position for performing exchange (automatic exchange) of the tool.

The above bending system includes a tool exchange unit for exchanging tools with respect to a tool holder of the press brake and the stocker positioned at the exchange position. The tool exchange unit is disposed on the back side of a table of the press brake table so as to be movable in the left-right direction. The tool exchange unit includes a tool retention member for retaining the tools. The tool retention member is engageable—with and disengageable—from an engagement holes of the tools. The bending system includes a servo motor as a left-right moving unit configured to move the tool exchange unit in the left-right direction.

Patent Literature 2 proposes an upper holder for retaining upper tools of a press brake in an exchangeable manner. Patent Literature 3 proposes a tool installing and removing method and a tool storage of a press brake.

CITATION LIST

Patent Literature

Patent Literature 1: Japanese Patent No. 4672868
Patent Literature 2: Japanese Patent No. 5841800
Patent Literature 3: Japanese Patent No. 5947861

SUMMARY

Oil or the like often adheres to a side surface of the tool retained by the tool holder or the tool stocker. When a predetermined tool to be exchanged (to be transported) is in contact with another adjacent tool, the predetermined tool and the other tool may be bonded by oil or the like. If an attempt is made to transport the predetermined tool in this state in the left-right direction by the tool exchange unit, the other tool may be dragged by the predetermined tool and the position of the other tool may be shifted. As a result, the bending system may not be able to grasp the position at which the other tool is placed, and may not be able to stably perform an operation related to automatic tool exchange, which include an operation to transport the tools. If escape processing or taper processing is applied to a side surface of the tool as post-processing in order to prevent bonding between the adjacent tools, which causes the position of the other tool to be shifted, manufacturing cost (processing cost) of the tool is increased.

In other words, there is a problem that it is not easy to stably perform an operation related to automatic exchange of tools by a bending system while suppressing an increase in manufacturing cost of the tools.

The present invention aims at providing a bending system and a tool transport method capable of transporting only a predetermined tool to be exchanged in the left-right direction by a tool exchange unit without performing post-processing on a side surface of the tool.

A bending system according to an embodiment of the present invention includes a tool storage placed in a vicinity of a press brake and including a plurality of stockers extending in a left-right direction so as to be able to retain a plurality of tools, a first tool exchange unit and a second tool exchange unit each disposed on a back side or a front side of a table of the press brake so as to be movable in the left-right direction and configured to exchange a tool with respect to a tool holder of the press brake and a stocker selected from among the plurality of stockers, a left-right moving unit configured to move the first tool exchange unit and the second tool exchange unit in the left-right direction, respectively, and a control unit configured to control the first tool exchange unit, the second tool exchange unit, and the left-right moving unit. The first tool exchange unit includes a first tool retention member engageable—with and disengageable—from an engagement hole of a tool, the first tool retention member being able to retain the tool and configured to move in the left-right direction together with the first tool exchange unit. The second tool exchange unit includes a second tool retention member engageable—with and disengageable—from an engagement hole of a tool, the second tool retention member being able to retain the tool and configured to move in the left-right direction together with the second tool exchange unit. The control unit, when a first tool to be exchanged is in contact with an adjacent second tool not to be exchanged in the tool holder or the selected stocker, controls the first tool exchange unit, the second tool exchange unit, and the left-right moving unit such that the first tool retention member retains the first tool in a state of being engaged in an engagement hole of the first tool, the second tool retention member retains the second tool in a state of being engaged in an engagement hole of the second tool, and the first tool exchange unit subsequently moves in the left-right direction in a state in which a movement of the second tool exchange unit in the left-right direction is stopped.

A tool transport method according to an embodiment of the present invention is a tool transport method using a first tool exchange unit and a second tool exchange unit disposed on a back side or a front side of a table of a press brake so as to be movable in a left-right direction. The tool transport method includes, when a first tool to be exchanged is in contact with an adjacent second tool not to be exchanged in a tool holder of the press brake or in a selected stocker in a tool storage placed in a vicinity of the press brake, retaining, by a first tool retention member of the first tool exchange unit, the first tool in a state in which the first tool retention member is engaged in an engagement hole of the first tool, retaining, by a second tool retention member of the second tool exchange unit, the second tool in a state in which the second tool retention member is engaged in an engagement hole of the second tool, and subsequently moving the first tool exchange unit in the left-right direction in a state in which a movement of the second tool exchange unit in the left-right direction is stopped.

According to the above configuration, since the second tool not to be exchanged is not dragged by the first tool to be exchanged, the position of the second tool is not shifted. As a result, only the first tool to be exchanged can be transported in the left-right direction by the first and second tool exchange units without performing post-processing on a side surface of the tool.

Therefore, it is possible to stably perform an operation related to automatic exchange of tools while suppressing an increase in manufacturing cost of the tools.

DESCRIPTION OF EMBODIMENT

Figure 1:
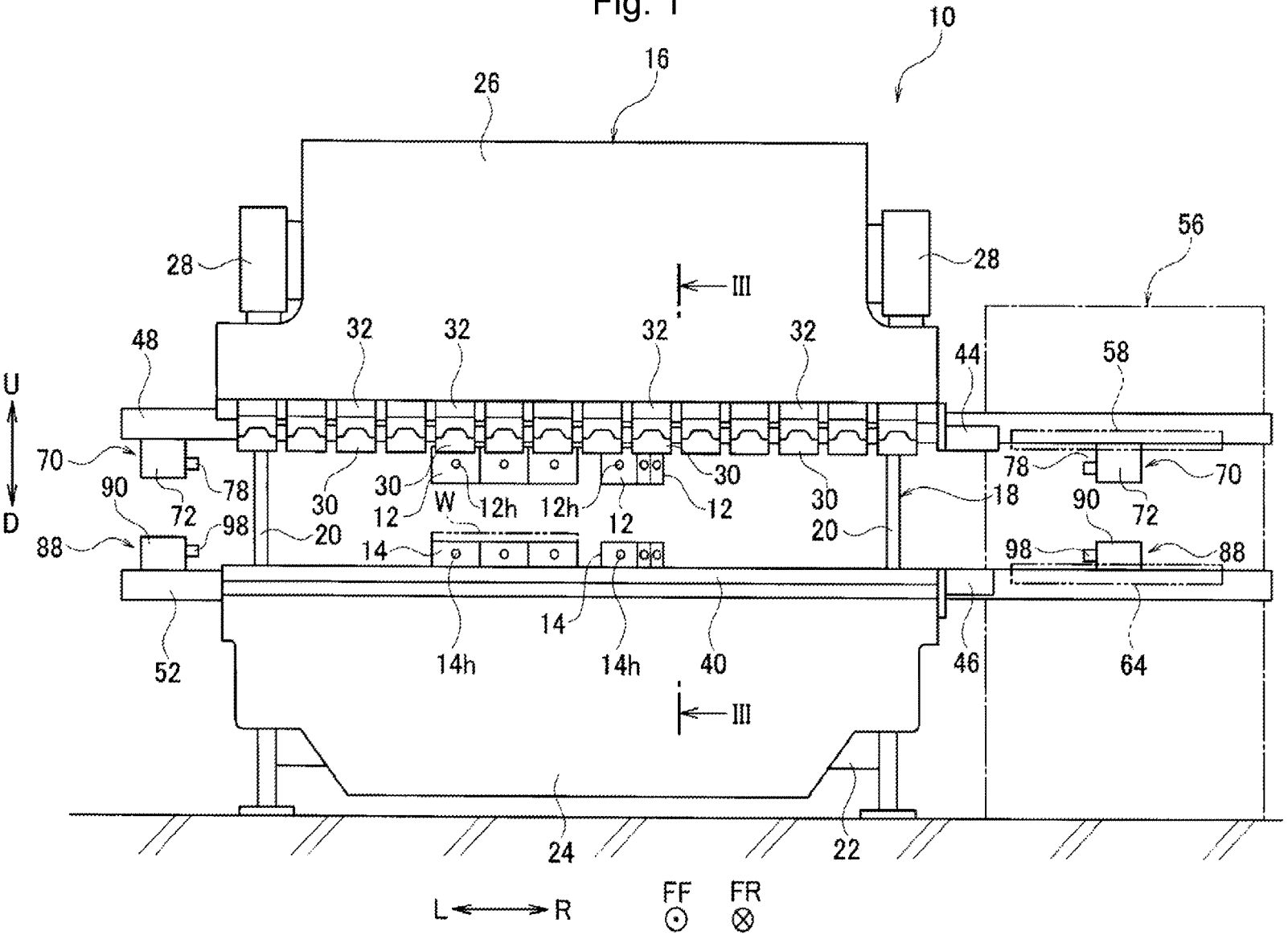
FIG. 1 is a schematic front view illustrating a bending system according to an embodiment of the present invention.

Embodiments of the present invention will be described with reference to FIGS. 1 to 7C.

It should be noted that the "left-right direction" is one of the horizontal directions, which is the width direction of a press brake 16 or a tool storage 56. The "front-back direction" is the depth direction of the press brake 16 or the tool storage 56. The "tool" includes an upper tool and a lower tool. The "last tool" is the tool at the end when viewed from the tool transport direction. The "leading tool" is the tool at the foremost position when viewed from the tool transport direction. In the drawings, "FF" indicates the forward direction, "FR" indicates the backward direction, "L" indicates the left direction, "R" indicates the right direction, "U" indicates the upward direction, and "D" indicates the downward direction. For convenience of explanation, in FIGS. 5A to 7C, of the engagement holes of the plurality of punch tools, only an engagement hole 12*h* that is in a state of being engaged with an upper tool retention member 78 is illustrated.

Figure 2:
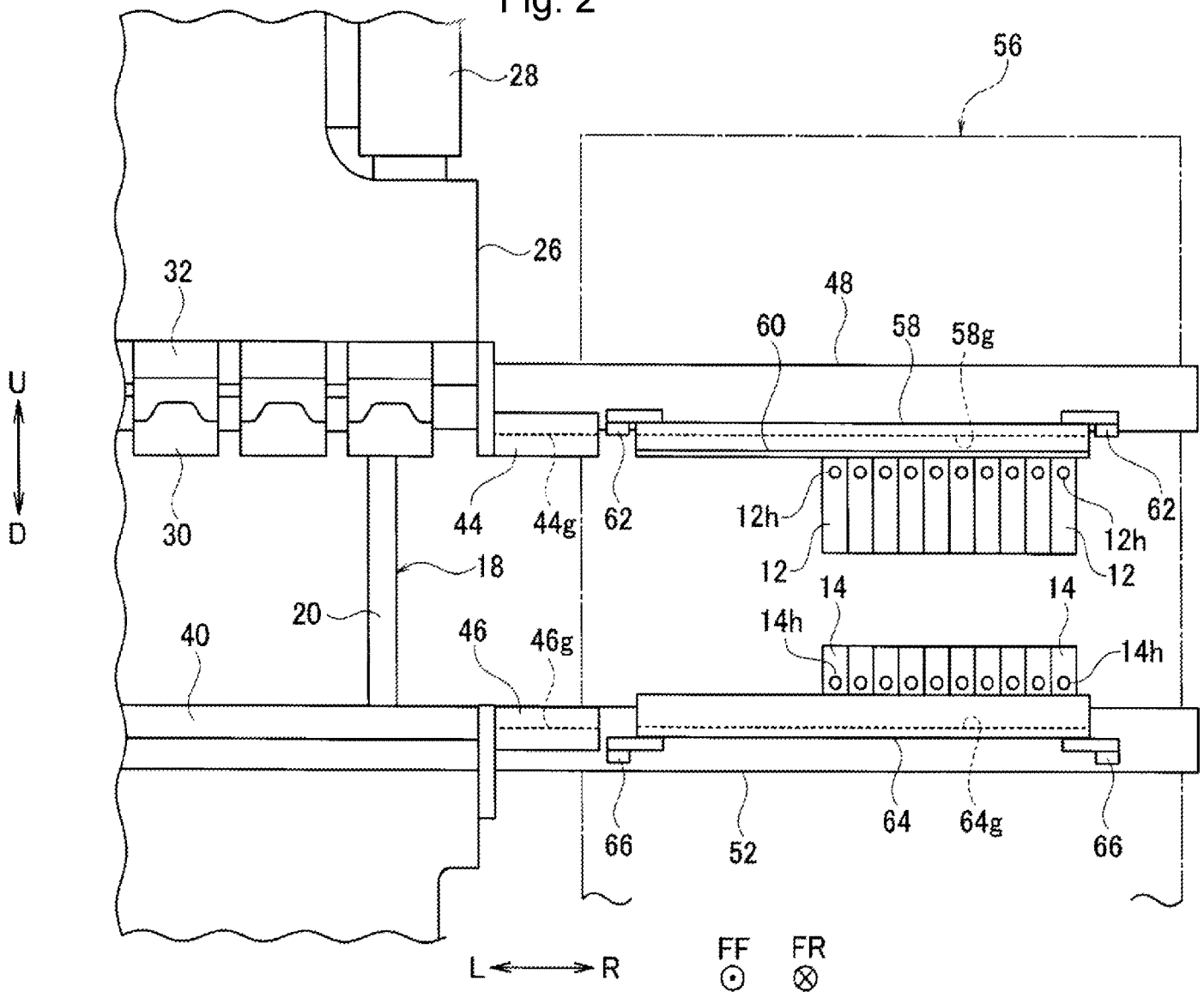
FIG. 2 is a schematic front view illustrating a vicinity of stockers (upper stocker and lower stocker) positioned at the tool exchange positions.
Figure 3:
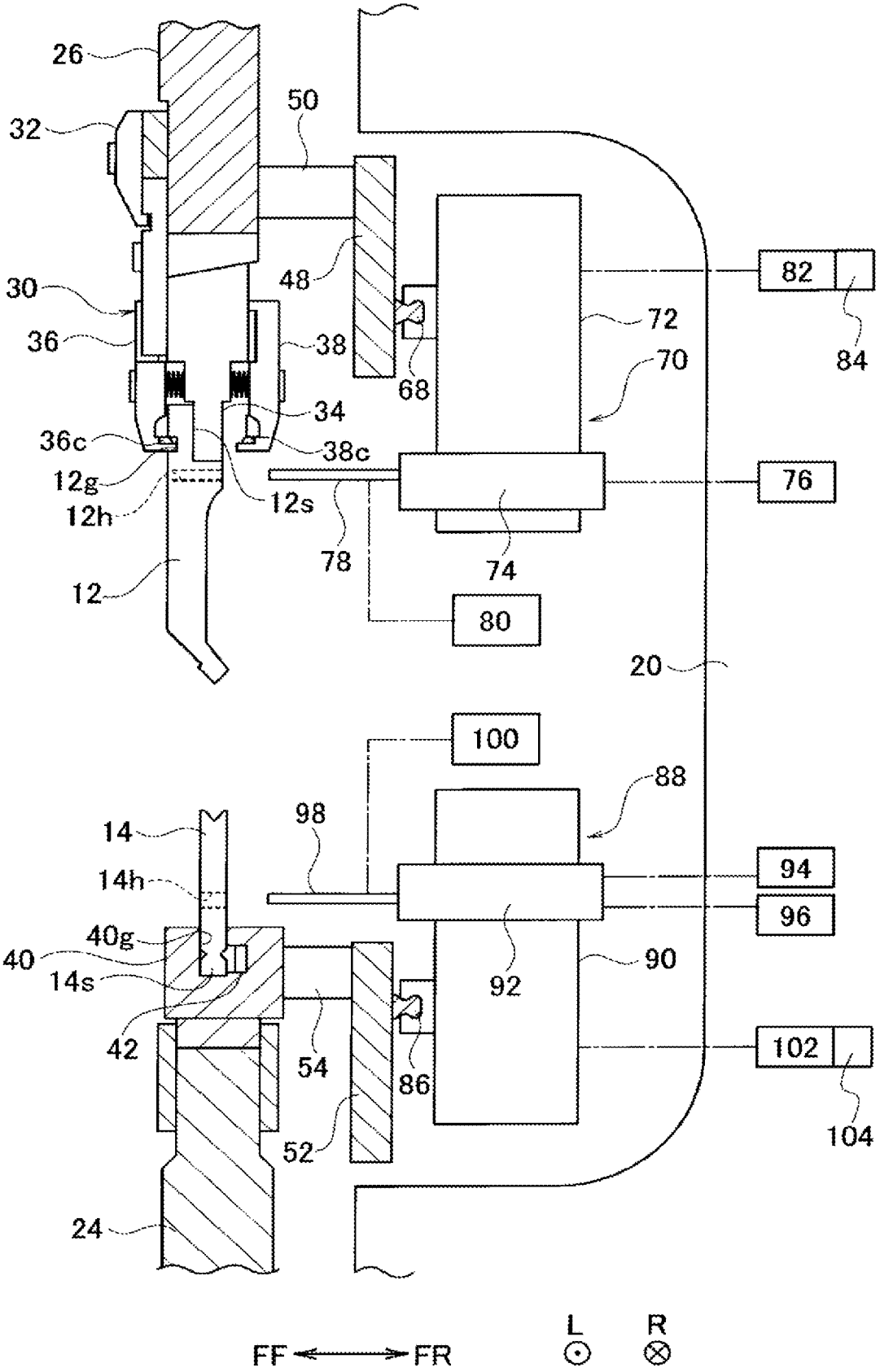
FIG. 3 is an enlarged cross-sectional view taken along the line in FIG. 1.

As illustrated in FIGS. 1 to 3, a bending system 10 according to the present embodiment is a system for bending a plate-shaped workpiece (sheet metal) W by using a punch tool 12 as an upper tool and a die tool 14 as a lower tool that are automatically exchangeable. The engagement hole 12*h* in a circular hole shape or in an elongated hole shape is formed in the central portion of the punch tool 12 in the width direction so as to penetrate in the front-back direction. On a shank 12*s* as the base portion of the punch tool 12, an engagement groove 12*g* for preventing the punch tool 12 from dropping is formed (see FIG. 3). An engagement hole 14*h* in a circular hole shape or in an elongated hole shape is formed in the central portion of the die tool 14 in the width direction so as to penetrate in the front-back direction (see FIG. 3).

The bending system 10 includes a press brake 16 for bending a work W by the cooperation of the punch tool 12 and the die tool 14.

A configuration of the press brake 16 will be specifically described. The press brake 16 includes a main frame 18. The main frame 18 includes a pair of side plates 20 that are separated from each other in the left-right direction and face each other, and a plurality of connecting members 22 that connect the pair of side plates 20 to each other. A lower table 24 extending in the left-right direction is disposed at the lower part of the main frame 18. An upper table 26 extending in the left-right direction is disposed at the upper part of the main frame 18 so as to be vertically movable. A hydraulic cylinder 28 is disposed at the upper part of each side plate 20 as a vertical moving unit for vertically moving the upper table 26. It should be noted that, instead of configuring the upper table 26 so as to be vertically movable, the lower table 24 may be configured to be vertically movable. Instead of the hydraulic cylinder 28, a servo motor (not illustrated) may be used as the vertical moving unit.

At a lower end portion of the upper table 26, a plurality of upper tool holders 30 are disposed at intervals in the left-right direction via fixture plates (fastening plates) 32. Each upper tool holder 30 retains the punch tool 12 in an installable and removable manner. Each upper tool holder 30 has a known configuration, for example, shown in Patent Literature 2 and includes a holder main body 34. A front clamp plate 36 for pressing the shank 12*s* of the punch tool 12 in a rearward direction is disposed on a front side of each holder main body 34 so as to be swingable. Each front clamp plate 36 includes, on a lower end side thereof, a pawl 36*c* that can be engaged in an engagement groove 12*g* of the punch tool 12. A rear clamp plate 38 for pressing, in a forward direction, the shank 12*s* of the punch tool 12 in a state in which the front and back sides are inverted (in the front-back direction) is disposed on a rear side of each holder main body 34 so as to be swingable. Each rear clamp plate 38 includes, on a lower end side thereof, a pawl 38*c* that can be engaged in the engagement groove 12*g* of the punch tool 12 in the state in which the front and back sides are inverted.

A lower tool holder 40 extending in the left-right direction is disposed on the upper side of the lower table 24. The lower tool holder 40 retains the die tool in an installable and removable manner. A holder groove 40*g* having a known configuration, for example, shown in Patent Literatures 2 and 3, for allowing a shank 14*s* of the die tool 14 to be inserted into is formed on the lower tool holder 40 along the left-right direction. The lower tool holder 40 includes a clamper 42 for securing (pressing) the die tool 14.

An upper joint block 44 extending in the left-right direction is disposed on the right side portion of the upper table 26. A joint groove 44*g* for allowing the shank 12*s* of the punch tool 12 to be inserted into is formed on the upper joint block 44 along the left-right direction. The joint grooves 44*g* of the upper joint blocks 44 are placed in series along the left-right direction in respective gaps between the holder main bodies 34 and the front clamp plates 36 in the plurality of upper tool holders 30.

A lower joint block 46 extending in the left-right direction is disposed on the right side portion of the lower table 24. A joint groove 46*g* for allowing the shank 14*s* of the die tool 14 to be inserted into is formed on the lower joint block 46 along the left-right direction. The joint groove 46*g* of the lower joint block is connected to the holder groove 40*g* of the lower tool holder 40.

An upper support beam 48 extending in the left-right direction is disposed on the back side (rear side) of the upper table 26 via a plurality of brackets 50 (only one is illustrated). The upper support beam 48 projects to the right of the upper joint block 44. A lower support beam 52 extending in the left-right direction is disposed on the back side of the lower table 24 via a plurality of brackets 54 (only one is illustrated). The lower support beam 52 projects to the right of the lower joint block 46.

As illustrated in FIGS. 1 and 2, the tool storage 56 for storing the plurality of punch tools 12 and the plurality of die tools 14 is placed on the lateral side of the press brake 16 in the left-right direction (an example of the vicinity of the press brake 16). The tool storage 56 has, for example, the same configuration as the known configurations shown in Patent Literatures 1 and 3.

The configuration of the tool storage 56 will be briefly described. The tool storage 56 includes a plurality of upper stockers 58 (only one is illustrated) for retaining the plurality of punch tools 12. Although only the upper stocker 58 positioned at an upper exchange position for exchanging the punch tool 12 is illustrated, the plurality of upper stockers 58 are placed along the front-back direction. Each upper stocker 58 extends in the left-right direction. A stocker groove 58*g* for allowing the shank 12*s* of the punch tool 12 to be inserted into is formed along the left-right direction on each upper stocker 58. Each upper stocker 58 includes an engagement plate 60 that can be engaged in an engagement groove 12*g* of the punch tool 12. Any selected upper stocker 58 is configured to be able to be positioned at the upper exchange position by an upper stocker moving mechanism (not illustrated). The upper stocker 58 positioned at the upper exchange position is supported by a pair of upper receiving members 62 disposed on the right end side of the front surface of the upper support beam 48.

The tool storage 56 includes a plurality of lower stockers 64 (only one is illustrated) for retaining the plurality of die tools 14. Although only the lower stocker 64 positioned at a lower exchange position for exchanging the die tool 14 is illustrated, the plurality of lower stockers 64 are placed along the front-back direction. Each lower stocker 64 extends in the left-right direction. A stocker groove 64*g* for allowing the shank 14*s* of the die tool 14 is inserted into is formed along the left-right direction on each lower stocker 64. Any selected lower stocker 64 is configured to be able to be positioned at the lower exchange position by a lower stocker moving mechanism (not illustrated). The lower stocker 64 positioned at the lower exchange position is supported by a pair of lower receiving members 66 disposed on the right end side of the front surface of the lower support beam 52.

As illustrated in FIG. 3, an upper guide rail 68 extending in the left-right direction is disposed on the back surface (rear surface) of the upper support beam 48. On the upper guide rail 68, a pair of upper tool exchange units 70 for exchanging the punch tool 12 for the plurality of upper tool holders 30 and the upper stocker 58 positioned at the upper exchange position are disposed so as to be movable in the left-right direction. In other words, the pair of upper tool exchange units 70 are disposed on the back side of the upper table 26 via the upper support beam 48 and the upper guide rail 68 so as to be movable in the left-right direction. Each upper tool exchange unit 70 transports the punch tool 12 between the upper tool holder 30 and the upper stocker 58 positioned at the upper exchange position. The pair of upper tool exchange units 70 includes a first upper tool exchange unit 70 and a second upper tool exchange unit 70.

Each upper tool exchange unit 70 has the same configuration as the known configuration shown in Patent Literature 1. Each upper tool exchange unit 70 includes an upper unit main body 72 and an upper support member 74. Each upper unit main body 72 is disposed on the upper guide rail 68 so as to be movable in the left-right direction. Each upper support member 74 is disposed on the upper unit main body. 72 so as to be movable in the front-back direction. Each upper support member 74 moves in the front-back direction with respect to each upper unit main body 72 by a drive of an air cylinder 76 as a front-back moving unit disposed at an appropriate position of each upper unit main body 72. It should be noted that the upper support member 74 may be configured to be vertically movable with respect to the upper unit main body 72.

Each upper tool exchange unit 70 includes an upper tool retention member 78 that is disposed on each upper support member 74 so as to be movable in the front-back direction and retains the punch tool 12. The distal end side of each upper tool retention member 78 is formed in a round-bar shape or a hook shape. Each upper tool retention member 78 is engageable—with and disengageable—from an engagement hole 12*h* of the punch tool 12. Each upper tool retention member 78 moves in the front-back direction with respect to each upper support member 74 by a drive of an air cylinder 80 as another front-back moving unit disposed at an appropriate position of each upper support member 74.

A servo motor 82 as a left-right moving unit configured to move each upper tool exchange unit 70 in the left-right direction is disposed at an appropriate position of each upper unit main body 72. Each servo motor 82 includes an encoder 84 as a position detector for detecting the position of each upper tool exchange unit 70 (each upper tool retention member 78) in the left-right direction. Each servo motor 82 includes a first servo motor 82 and a second servo motor 82. Each encoder 84 includes a first encoder 84 and a second encoder 84.

As illustrated in FIG. 3, a lower guide rail 86 extending in the left-right direction is disposed on the back surface of the lower support beam 52. On the lower guide rail 86, a pair of lower tool exchange units 88 for exchanging the die tool 14 for the plurality of lower tool holders 40 and the lower stocker 64 positioned at the lower exchange position are disposed so as to be movable in the left-right direction. In other words, the pair of lower tool exchange units 88 are disposed on the back side of the lower table 24 via the lower support beam 52 and the lower guide rail 86 so as to be movable in the left-right direction. Each lower tool exchange unit 88 transports the die tool 14 between the lower tool holder 40 and the lower stocker 64 positioned at the lower exchange position. The pair of lower tool exchange units 88 includes a first lower tool exchange unit 88 and a second lower tool exchange unit 88.

Each lower tool exchange unit 88 has the same configuration as the known configuration shown in Patent Literature 1. Each lower tool exchange unit 88 includes a lower unit main body 90 and a lower support member 92. The lower unit main body 90 is disposed on the lower guide rail 86 so as to be movable in the left-right direction. The lower support member 92 is disposed on the lower unit main body 90 so as to be movable in the front-back direction and vertically. Each lower support member 92 moves in the front-back direction with respect to each lower unit main body 90 by a drive of an air cylinder 94 as a front-back moving unit disposed at an appropriate position of each lower unit main body 90. Each lower support member 92 moves vertically with respect to each lower unit main body 90 by a drive of an air cylinder 96 as a vertical moving unit disposed at an appropriate position of each lower unit main body 90.

Each lower tool exchange unit 88 includes a lower tool retention member 98 that is disposed on each lower support member 92 so as to be movable in the front-back direction and retains the die tool 14. The distal end side of each lower tool retention member 98 is formed in a round-bar shape or a hook shape. Each lower tool retention member 98 is engageable—with and disengageable—from an engagement hole 14*h* of the die tool 14. Each lower tool retention member 98 moves in the front-back direction with respect to each lower support member 92 by a drive of an air cylinder 100 as another front-back moving unit disposed at an appropriate position of each lower support member 92.

A servo motor 102 as a left-right moving unit configured to move each lower tool exchange unit 88 in the left-right direction is disposed at an appropriate position of each lower unit main body 90. Each servo motor 102 includes an encoder 104 as a position detector for detecting the position of each lower tool exchange unit 88 (each lower tool retention member 98) in the left-right direction. Each servo motor 102 includes a first servo motor 102 and a second servo motor 102. Each encoder 104 includes a first encoder 104 and a second encoder 104.

Figure 4:
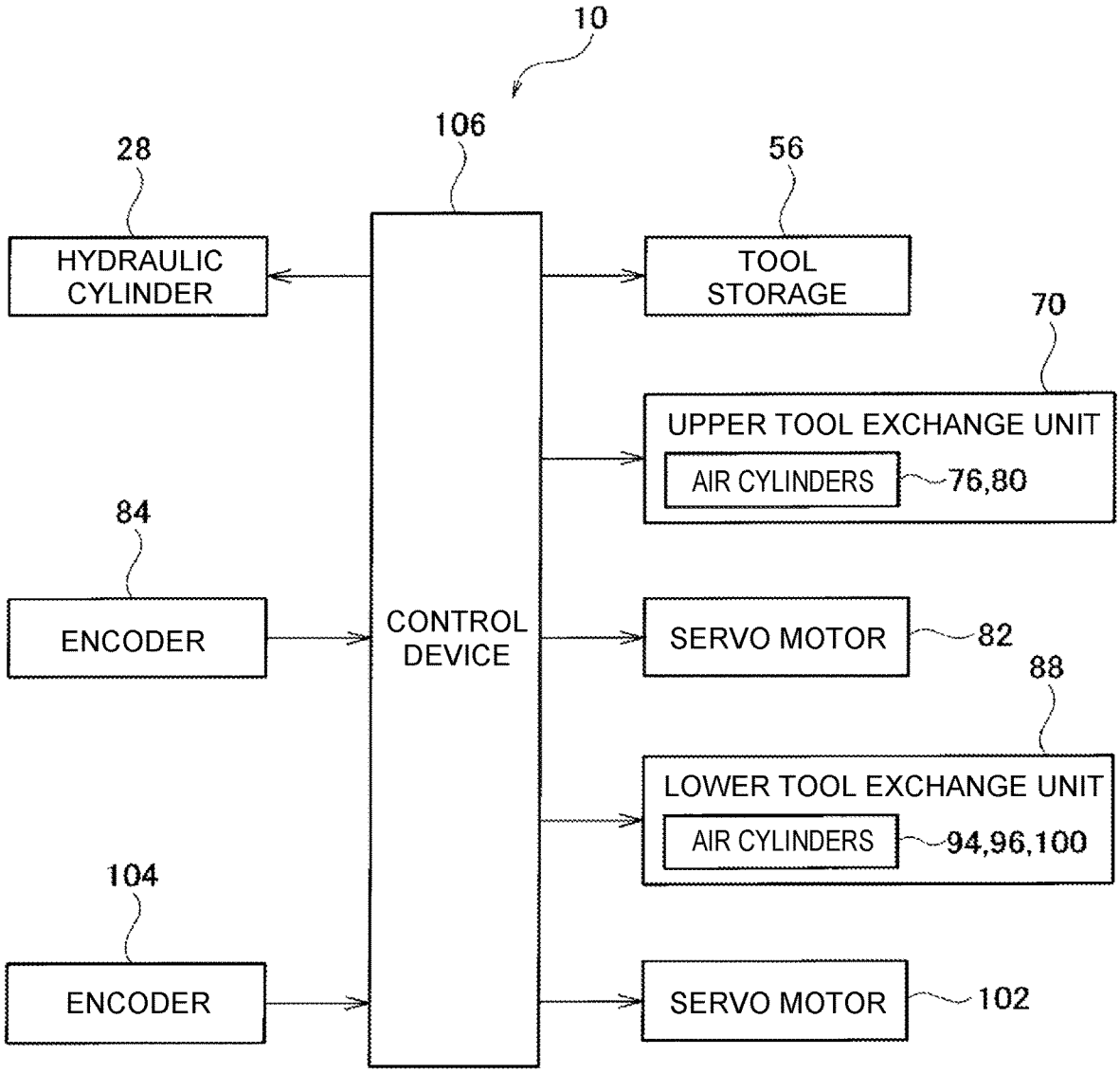
FIG. 4 is a control block diagram of the bending system according to the embodiment of the present invention.

As illustrated in FIG. 4, the bending system 10 includes a control device (an NC device) 106 as a control unit. The control device 106 controls the hydraulic cylinder 28 and the like on the basis of a processing program, and controls the tool storage 56, the upper tool exchange unit 70, and the like on the basis of a tool exchange program. The control device 106 is configured with a computer. The encoders 84, 104, and the like are connected to the control device 106. The control device 106 includes a memory (not illustrated) for storing the processing program, the tool exchange program, and the like, and a CPU (not illustrated) for executing the processing program and the tool exchange program.

In the plurality of upper tool holders 30, when the predetermined punch tool 12 to be exchanged (to be transported) is in contact with an adjacent another punch tool 12' not to be exchanged (see FIG. 5A), the control device 106 controls the first upper tool exchange unit 70 and the first servo motor 82 so that the upper tool retention member 78 of the first upper tool exchange unit 70 retains the predetermined punch tool 12 in a state of being engaged in the engagement hole 12*h* of the predetermined punch tool 12. Further, the control device 106 controls the second upper tool exchange unit 70 and the second servo motor 82 so that the upper tool retention member 78 of the second upper tool exchange unit 70 retains the other punch tool 12' in a state of being engaged in an engagement hole 12*h'* of the other punch tool 12' (see FIG. 5B). Subsequently, the control device 106 controls each servo motor 82 so that the first upper tool exchange unit 70 moves in the left-right direction until a target position is reached while acquiring the detection result from the first encoder 84 in a state in which a movement of the second upper tool exchange unit 70 in the left-right direction is stopped (see FIG. 5C).

Here, the control device 106 can grasp that the predetermined punch tool 12 is in contact with the adjacent other punch tools 12' in the plurality of upper tool holders 30 on the basis of the tool exchange program.

In the above case and when there are a plurality of the predetermined punch tools 12 (see FIG. 6A), the control device 106 controls the first upper tool exchange unit 70 and the first servo motor 82 so that the upper tool retention member 78 of the first upper tool exchange unit 70 retains the last punch tool 12 (the punch tool 12 on the left side in FIGS. 6A to 6E) from among the plurality of predetermined punch tools 12 in a state of being engaged in the engagement hole 12*h* of the last punch tool 12. Further, the control device 106 controls the second upper tool exchange unit 70 and the second servo motor 82 so that the upper tool retention member 78 of the second upper tool exchange unit 70 retains the other punch tool 12' in a state of being engaged in the engagement hole 12*h'* of the other punch tool 12' (see FIG. 6B). Subsequently, the control device 106 controls each servo motor 82 so that the first upper tool exchange unit 70 moves in the left-right direction by a predetermined amount while acquiring the detection result from the first encoder 84 in a state in which the movement of the second upper tool exchange unit 70 in the left-right direction is stopped (see FIG. 6C). Here, the predetermined amount is a movement amount set in advance for separating the last punch tool 12 from the other punch tool 12'.

Thereafter, the control device 106 controls the first upper tool exchange unit 70 and the first servo motor 82 so that the upper tool retention member 78 of the first upper tool exchange unit 70 retains a leading punch tool 12 (the punch tool 12 on the right side in FIGS. 6A to 6E) from among the plurality of predetermined punch tools in a state of being engaged in the engagement hole 12*h* of the leading punch tool 12. Further, the control device 106 controls the second upper tool exchange unit 70 and the second servo motor 82 so that the upper tool retention member 78 of the second upper tool exchange unit 70 retains the last punch tool 12 in a state of being engaged in the engagement hole 12*h* of the last punch tool 12 (see FIG. 6D). Subsequently, the control device 106 controls each servo motor 82 so that each upper tool exchange unit 70 moves in the left-right direction synchronously (or asynchronously) until a target position is reached while acquiring the detection result from each encoder 84 (see FIG. 6E).

It should be noted that the plurality of predetermined punch tools 12 may include an intermediate punch tool (not illustrated) that is between the leading punch tool 12 and the last punch tool 12. In other words, the number of predetermined punch tools 12 may be three or more. Further, instead of moving the first upper tool exchange unit 70 in the left-right direction by a predetermined amount from the state illustrated in FIG. 6B, each servo motor 82 may be controlled to be moved in the left-right direction until the target position is reached.

In the above case and when there are a plurality of the predetermined punch tools 12, before the upper tool retention member 78 of the first upper tool exchange unit 70 retains the last punch tool 12 (see FIG. 7C), the control device 106 may control each upper tool exchange unit 70 and each servo motor 82 as follows.

In other words, the control device 106 control the first upper tool exchange unit 70 and the first servo motor 82 so that the upper tool retention member 78 of the first upper tool exchange unit 70 retains the leading punch tool 12 in a state of being engaged in the engagement hole 12*h* of the leading punch tool 12. Further, the control device 106 control the second upper tool exchange unit 70 and the second servo motor 82 so that the upper tool retention member 78 of the second upper tool exchange unit 70 retains the last punch tool 12 in a state of being engaged in the engagement hole 12*h* of the last punch tool 12 (see FIG. 7A). Subsequently, the control device 106 controls each servo motor 82 so that the first upper tool exchange unit 70 moves in the left-right direction by a predetermined amount while acquiring the detection result from the first encoder 84 in a state in which the movement of the second upper tool exchange unit 70 in the left-right direction is stopped (see FIG. 7B). Here, the predetermined amount is a movement amount set in advance for separating the leading punch tool 12 from the last punch tool 12.

When the predetermined punch tool 12 to be exchanged (to be transported) is in contact with the adjacent other punch tool 12' not to be exchanged not only in the plurality of upper tool holders 30 but also in the upper stocker 58 positioned at the upper exchange position, the control device 106 also controls each upper tool exchange unit 70 and each servo motor 82 in the same manner as described above. Further, when the predetermined die tool 14 to be exchanged (to be transported) is in contact with the adjacent other die tool not to be exchanged (not illustrated) on the lower tool holder 40 and in the lower stocker 64 positioned at the lower exchange position, the control device 106 also controls each lower tool exchange unit 88 and each servo motor 102 in the same manner as described above.

The operation related to automatic exchange of the tools 12 and 14 by the bending system 10 will be described.

A control when the punch tool 12 is transported from the upper tool holder 30 to the upper stocker 58 positioned at the upper exchange position will be described. The control device 106 controls the servo motor 82 to move the upper tool exchange unit 70 in the left-right direction so that the upper tool retention member 78 is opposed to the engagement hole 12*h* of the punch tool 12 installed in the upper tool holder 30. Next, the control device 106 causes the upper tool retention member 78 to retain the punch tool 12 while engaging the upper tool retention member 78 in the engagement hole 12*h* of the punch tool 12. Then, the control device 106 controls the servo motor 82 to move the upper tool exchange unit 70 to the right so that the punch tool 12 is transported to the right and removed from the upper tool holder 30. Furthermore, the control device 106 controls the servo motor 82 to move the upper tool exchange unit 70 to the right so that the punch tool 12 is transported to the right and installed in the upper stocker 58. Thereafter, the control device 106 causes the upper tool retention member 78 to be removed from the engagement hole 12*h* of the punch tool 12 so that the punch tool 12 is released from a state in which the punch tool 12 is retained by the upper tool retention member 78.

It should be noted that the punch tool 12 may be moved to the back side (rear side) of the upper table 26 by the upper tool exchange unit 70 after the punch tool 12 is removed from the upper tool holder 30.

When the punch tool 12 is transported from the upper stocker 58 positioned at the upper exchange position to the upper tool holder 30, the operation opposite to the above operation is performed. As a result, the punch tool 12 installed in the upper tool holder 30 and the punch tool 12 installed in the upper stocker 58 can be automatically exchanged.

When the die tool 14 is transported between the lower tool holder 40 and the lower stocker 64 positioned at the lower exchange position, the operation similar to the above is performed. As a result, the die tool 14 installed in the lower tool holder 40 and the die tool 14 installed in the lower stocker 64 can be automatically exchanged.

It should be noted that when the die tool 14 is installed in and removed from the lower tool holder 40 or the lower stocker 64, the die tool 14 may be moved vertically by the lower tool exchange unit 88.

Subsequently, the operation and effect of the embodiment of the present invention will be described, including the details of the tool transport method according to the embodiment of the present invention. The tool transport method according to the present embodiment is a method of transporting the tools 12 and 14 along the tool holders 30 and 40 or the stockers 58 and 64 positioned at the exchange positions.

Figure 5A:
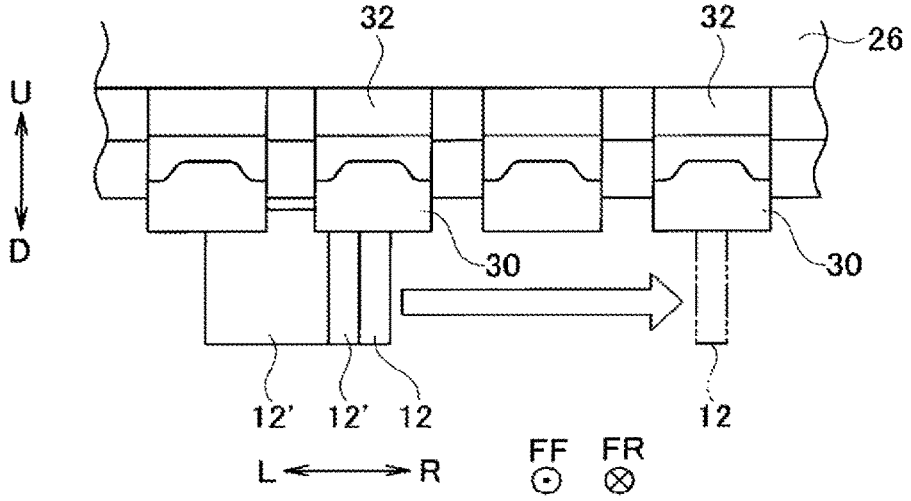
FIG. 5A is a diagram illustrating a state in which a predetermined punch tool is in contact with an adjacent another punch tool in a plurality of upper tool holders.
Figure 5B:
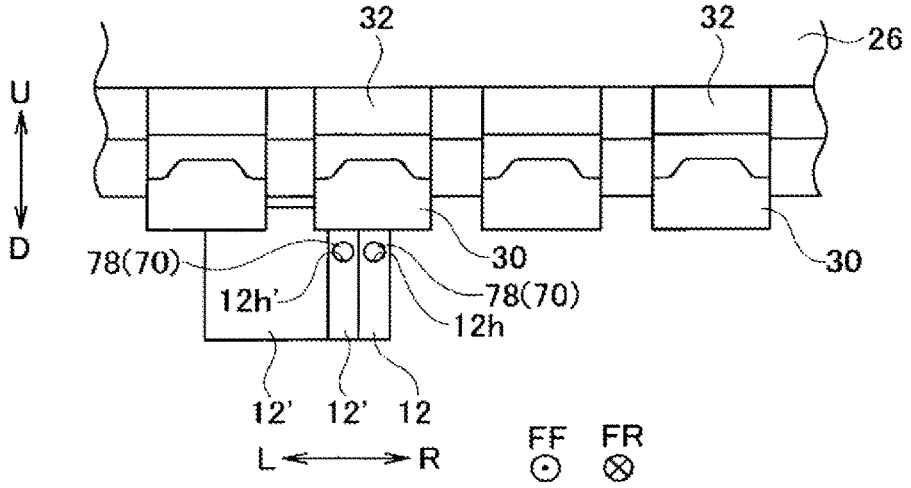
FIG. 5B is a diagram illustrating a state in which the predetermined punch tool is transported along the plurality of upper tool holders.
Figure 5C:
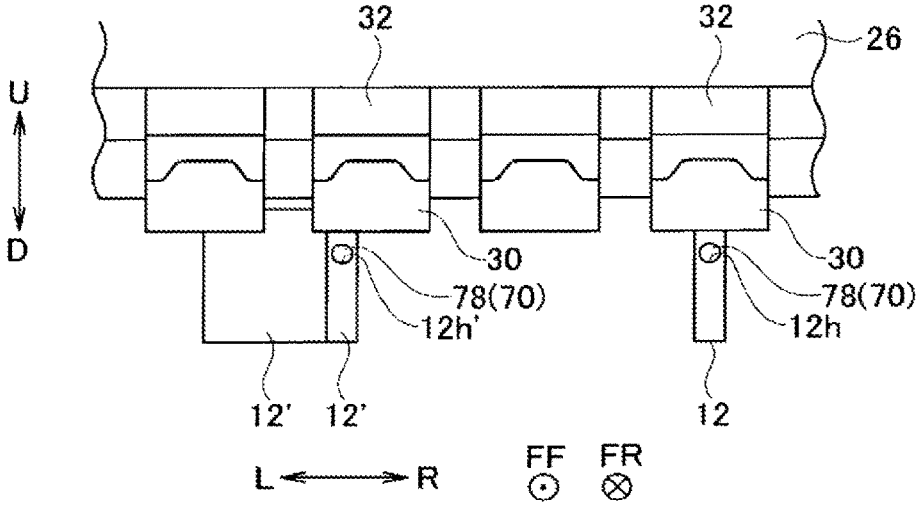
FIG. 5C is a diagram illustrating a state in which the predetermined punch tool is transported along the plurality of upper tool holders.
Figure 6A:
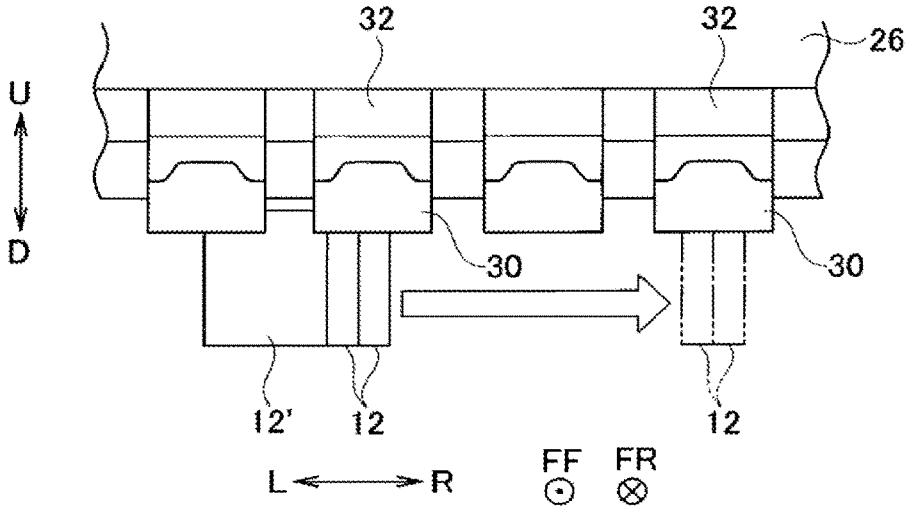
FIG. 6A is a diagram illustrating a state in which a plurality of predetermined punch tools are in contact with an adjacent another punch tool in the plurality of upper tool holders.
Figure 6B:
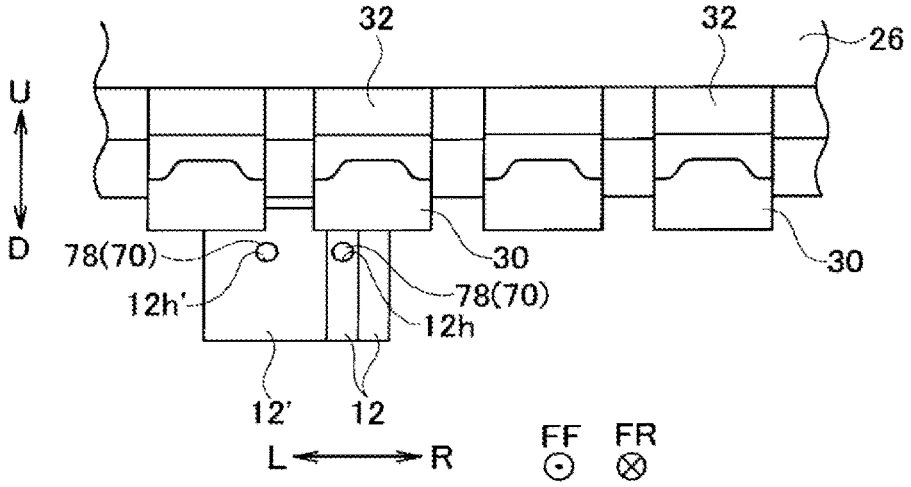
FIG. 6B is a diagram illustrating an operation for transporting the plurality of predetermined punch tools along the plurality of upper tool holders.
Figure 6C:
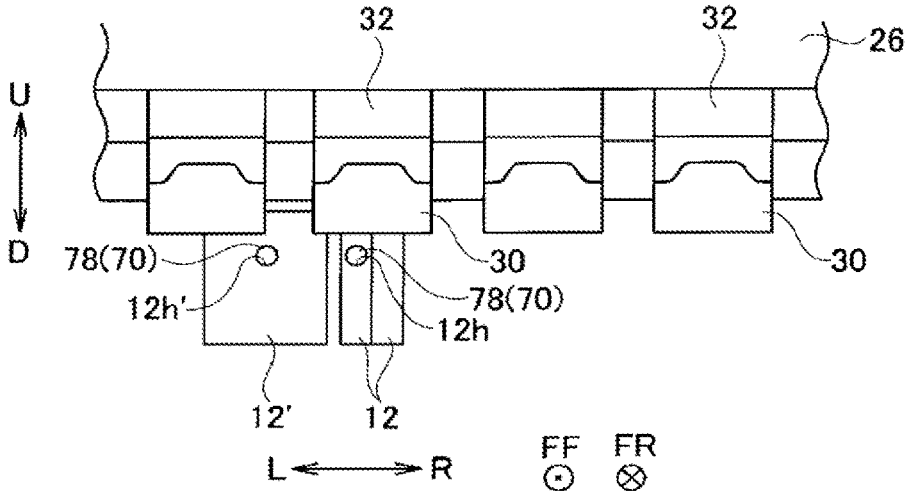
FIG. 6C is a diagram illustrating the operation for transporting the plurality of predetermined punch tools along the plurality of upper tool holders.
Figure 6D:
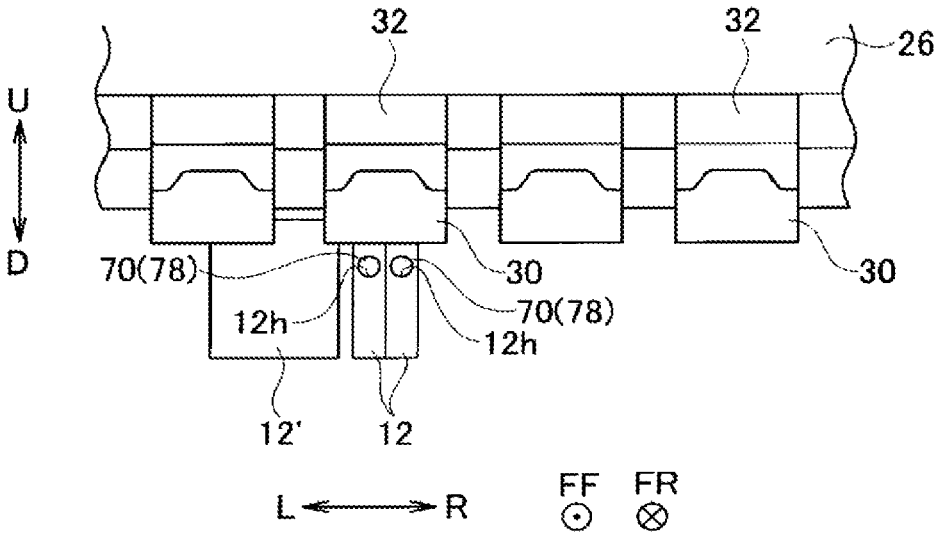
FIG. 6D is a diagram illustrating the operation for transporting the plurality of predetermined punch tools along the plurality of upper tool holders.
Figure 6E:
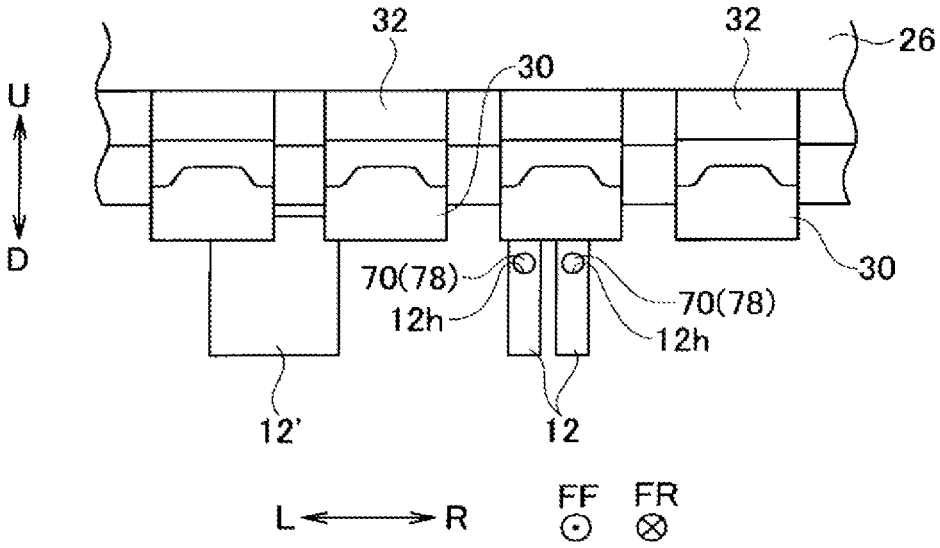
FIG. 6E is a diagram illustrating the operation for transporting the plurality of predetermined punch tools along the plurality of upper tool holders.

As illustrated in FIGS. 5A to 5C, when the predetermined punch tool 12 to be exchanged is in contact with the adjacent other punch tool 12' to be exchanged in the plurality of upper tool holders 30 (see FIG. 5A), the control device 106 controls each upper tool exchange unit 70 and each servo motor 82 so as to operate as follows.

The predetermined punch tool 12 is retained in a state in which the upper tool retention member 78 of the first upper tool exchange unit 70 is engaged in the engagement hole 12*h* of the predetermined punch tool 12. Further, the other punch tool 12' is retained in a state in which the upper tool retention member 78 of the second upper tool exchange unit 70 is engaged in the engagement hole 12*h'* of the other punch tool 12' (see FIG. 5B). Subsequently, the first upper tool exchange unit 70 moves in the left-right direction until a target position is reached while acquiring the detection result from the first encoder 84 in a state in which the movement of the second upper tool exchange unit 70 in the left-right direction is stopped (see FIG. 5C). As a result, the position of the other punch tool 12' is not shifted because the other punch tool 12' is not dragged by the predetermined punch tools 12. Therefore, without performing post-processing on a side surface of the punch tool 12, only the predetermined punch tool 12 to be exchanged can be transported in the left-right direction by the upper tool exchange unit 70.

As illustrated in FIGS. 6A to 6E, in the above case and when there are a plurality of the predetermined punch tools 12 (see FIG. 6A), the control device 106 controls each upper tool exchange unit 70 and each servo motor 82 so as to operate as follows.

The last punch tool 12 is retained in a state in which the upper tool retention member 78 of the first upper tool exchange unit 70 is engaged in the engagement hole 12*h* of the last punch tool 12 from among the plurality of predetermined punch tools 12. Further, the other punch tool 12' is retained in a state in which the upper tool retention member 78 of the second upper tool exchange unit 70 is engaged in the engagement hole 12*h*' of the other punch tool 12' (see FIG. 6B). Subsequently, the first upper tool exchange unit 70 moves in the left-right direction by a predetermined amount in a state in which the movement of the second upper tool exchange unit 70 in the left-right direction is stopped (see FIG. 6C). As a result, the plurality of predetermined punch tools 12 can be separated from the other punch tools 12'.

Thereafter, the upper tool retention member 78 of the first upper tool exchange unit 70 retains the leading punch tool 12 in a state of being engaged in the engagement hole 12*h* of the leading punch tool 12 from among the plurality of predetermined punch tools 12. Further, the upper tool retention member 78 of the second upper tool exchange unit 70 retains the last punch tool 12 in a state of being engaged in the engagement hole 12*h* of the last punch tool 12 (see FIG. 6D). Subsequently, each upper tool exchange unit 70 moves in the left-right direction synchronously (or asynchronously) until a target position is reached (see FIG. 6E). As a result, the position of the other punch tool 12' is not shifted because the other punch tool 12' is not dragged by the plurality of predetermined punch tools 12. Therefore, without performing post-processing on a side surface of the punch tool 12, only the plurality of predetermined punch tools 12 to be exchanged can be transported by the upper tool exchange unit 70 in the left-right direction along the plurality of upper tool holders 30.

Figure 7A:
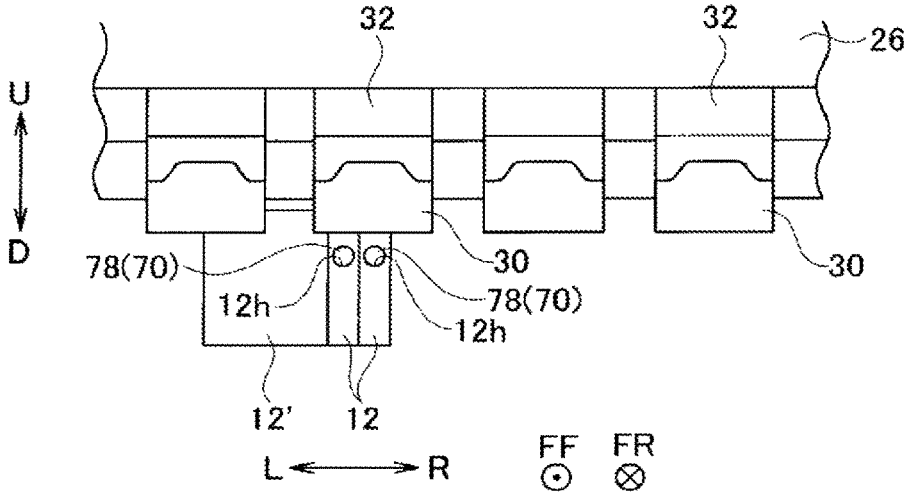
FIG. 7A is a diagram illustrating an operation for transporting the plurality of predetermined punch tools along a plurality of upper tool holders.
Figure 7B:
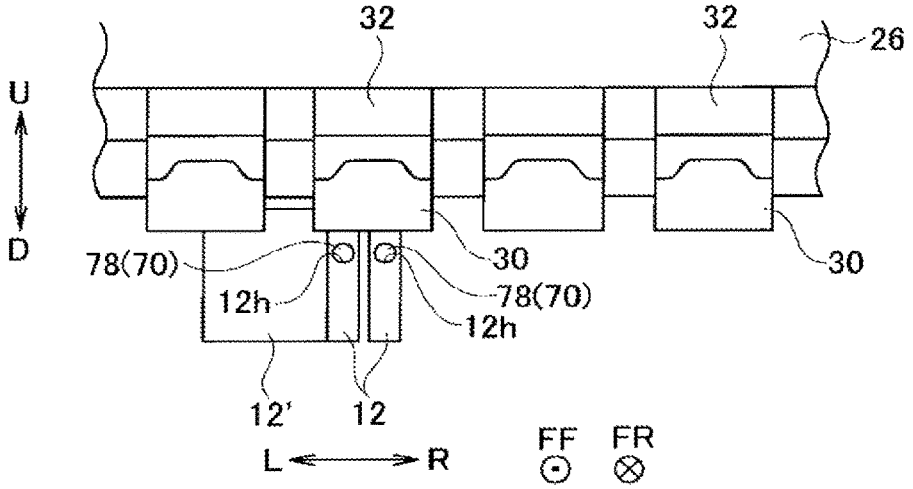
FIG. 7B is a diagram illustrating the operation for transporting the plurality of predetermined punch tools along the plurality of upper tool holders.
Figure 7C:
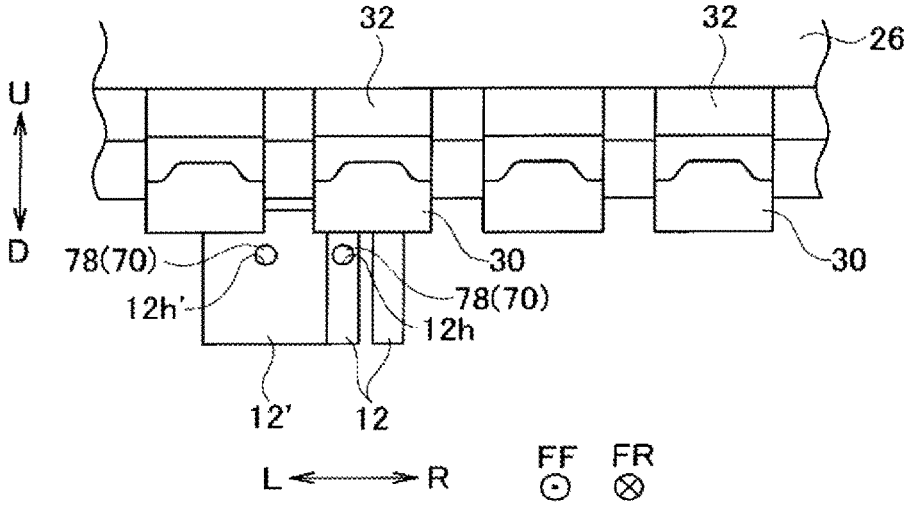
FIG. 7C is a diagram illustrating the operation for transporting the plurality of predetermined punch tools along the plurality of upper tool holders.

As illustrated in FIGS. 7A to 7C, before the upper tool retention member 78 of the first upper tool exchange unit 70 retains the last punch tool 12, the control device 106 may control each upper tool exchange unit 70 and each servo motor 82 so as to operate as follows.

The leading punch tool 12 is retained in a state in which the upper tool retention member 78 of the first upper tool exchange unit 70 is engaged in the engagement hole 12*h* of the leading punch tool 12. Further, the last punch tool 12 is retained in a state in which the upper tool retention member 78 of the second upper tool exchange unit 70 is engaged in the engagement hole 12*h* of the last punch tool 12 (see FIG. 7A). Subsequently, the upper tool exchange unit 70 moves in the left-right direction by a predetermined amount in a state in which the movement of the second upper tool exchange unit 70 in the left-right direction is stopped. As a result, the leading punch tool 12 can be separated from the last punch tool 12.

Here, in FIGS. 5A to 7C, the transport direction of the predetermined punch tool 12 is illustrated as the right direction, the upper tool exchange unit 70 on the right side is the first upper tool exchange unit 70, and the upper tool exchange unit 70 on the left side is the second upper tool exchange unit 70. When the transport direction of the predetermined punch tool 12 is changed to the left, the upper tool exchange unit 70 on the left side is the first upper tool exchange unit 70 and the upper tool exchange unit 70 on the right side is the second upper tool exchange unit 70. In other words, when the transport direction of the predetermined punch tool 12 is inverted, the first upper tool exchange unit 70 and the second upper tool exchange unit 70 are switched.

It should be noted that the control device 106 controls each upper tool exchange unit 70 and each servo motor 82 so as to operate in the same manner as described above when the predetermined punch tool 12 to be exchanged (to be transported) is in contact with the adjacent other punch tool 12' not to be exchanged not only in the plurality of the upper tool holder 30 but also in the upper stocker 58 positioned at the upper exchange position.

When the predetermined die tool 14 (or the plurality of predetermined die tools 14) to be exchanged (to be transported) is/are in contact with the adjacent other die tool not to be exchanged (not illustrated) in the lower tool holder 40 and the lower stocker 64 positioned at the lower exchange position, the control device 106 also controls each lower tool exchange unit 88 and each servo motor 102 so as to operate in the same manner as described above. As a result, the position of the other die tool is not shifted because the other die tool is not dragged by the predetermined die tool 14 (or the plurality of predetermined die tools 14). Therefore, without performing post-processing on a side surface of the die tool 14, only the predetermined die tool 14 (or the plurality of predetermined die tools 14) can be transported by the lower tool exchange unit 88 in the left-right direction along the lower tool holder 40.

Therefore, according to the embodiment of the present invention, it is possible to stably perform the operation related to automatic exchange of the tools 12 and 14 by the bending system 10 while suppressing an increase in manufacturing cost of the tools 12 and 14.

Instead of disposing the tool exchange units 70 and 88 on the back sides of the tables 26 and 24 so as to be movable in the left-right direction, the tool exchange units 70 and 88 may be disposed on the front sides of the tables 26 and 24 so as to be movable in the left-right direction. The location at which the tool storage 56 is placed may be other than the lateral side of the press brake 16 in the left-right direction as long as the location is in the vicinity of the press brake 16.

Although the embodiments have been described above, the embodiments are merely examples described for facilitating the understanding of the present disclosure. The technical scope of the present disclosure is not limited to the specific technical matters disclosed in the above-described embodiments, but also includes various modifications, changes, alternative technologies, and the like that can be easily derived therefrom.

The present invention has, for example, the following configurations.

A bending system includes a tool storage placed in a vicinity of a press brake and including a plurality of stockers extending in a left-right direction so as to be able to retain a plurality of tools, a first tool exchange unit and a second tool exchange unit each disposed on a back side or a front side of a table of the press brake so as to be movable in the left-right direction and configured to exchange a tool with respect to a tool holder of the press brake and a stocker selected from among the plurality of stockers, a left-right moving unit configured to move the first tool exchange unit and the second tool exchange unit in the left-right direction, respectively, and a control unit configured to control the first tool exchange unit, the second tool exchange unit, and the left-right moving unit. The first tool exchange unit includes a first tool retention member engageable—with and disengageable—from an engagement hole of a tool, the first tool retention member being able to retain the tool and configured to move in the left-right direction together with the first tool exchange unit. The second tool exchange unit includes a second tool retention member engageable—with and disengageable—from an engagement hole of a tool, the second tool retention member being able to retain the tool and configured to move in the left-right direction together with the second tool exchange unit. The control unit, when a first tool to be exchanged is in contact with an adjacent second tool not to be exchanged in the tool holder or the selected stocker, controls the first tool exchange unit, the second tool exchange unit, and the left-right moving unit such that the first tool retention member retains the first tool in a state of being engaged in an engagement hole of the first tool, the second tool retention member retains the second tool in a state of being engaged in an engagement hole of the second tool, and the first tool exchange unit subsequently moves in the left-right direction in a state in which a movement of the second tool exchange unit in the left-right direction is stopped.

According to the above configuration, since the second tool not to be exchanged is not dragged by the first tool to be exchanged, the position of the second tool is not shifted. As a result, only the first tool to be exchanged can be transported in the left-right direction by the first and second tool exchange units without performing post-processing on a side surface of the tool. Therefore, it is possible to stably perform an operation related to automatic exchange of tools while suppressing an increase in manufacturing cost of the tools.

In the bending system, when the first tool includes a plurality of first tools, the control unit may control the first tool exchange unit, the second tool exchange unit, and the left-right moving unit such that the first tool retention member retains a last tool from among the plurality of first tools in a state of being engaged in an engagement hole of the last tool, the last tool being in contact with the second tool, the second tool retention member retains the second tool in a state of being engaged in the engagement hole of the second tool, the first tool exchange unit subsequently moves in the left-right direction by a predetermined amount in a state in which the movement of the second tool exchange unit in the left-right direction is stopped, the first tool retention member thereafter retains a leading tool from among the plurality of first tools in a state of being engaged in an engagement hole of the leading tool, the second tool retention member retains the last tool in a state of being engaged in the engagement hole of the last tool, and the first tool exchange unit and the second tool exchange unit then move in the left-right direction.

In the bending system, before the first tool retention member retains the last tool, the control unit may control the first tool exchange unit, the second tool exchange unit, and the left-right moving unit such that the first tool retention member retains the leading tool in a state of being engaged in the engagement hole of the leading tool, the second tool retention member retains the last tool in a state of being engaged in the engagement hole of the last tool, and the first tool exchange unit subsequently moves in the left-right direction by a predetermined amount in a state in which the movement of the second tool exchange unit in the left-right direction is stopped.

A tool transport method uses a first tool exchange unit and a second tool exchange unit each disposed on a back side or a front side of a table of a press brake so as to be movable in a left-right direction. The tool transport method includes, when a first tool to be exchanged is in contact with an adjacent second tool not to be exchanged in a tool holder of the press brake or in a selected stocker in a tool storage placed in a vicinity of the press brake, retaining, by a first tool retention member of the first tool exchange unit, the first tool in a state in which the first tool retention member is engaged in an engagement hole of the first tool, retaining, by a second tool retention member of the second tool exchange unit, the second tool in a state in which the second tool retention member is engaged in an engagement hole of the second tool, and subsequently moving the first tool exchange unit in the left-right direction in a state in which a movement of the second tool exchange unit in the left-right direction is stopped.

According to the above configuration, since the second tool not to be exchanged is not dragged by the first tool to be exchanged, the position of the second tool is not shifted. As a result, only the first tool to be exchanged can be transported in the left-right direction by the first and second tool exchange units without performing post-processing on a side surface of the tool. Therefore, it is possible to stably perform an operation related to automatic exchange of tools while suppressing an increase in manufacturing cost of the tools.

The tool transport method described above may include, when the first tool includes a plurality of first tools, retaining, by the first tool retention member, a last tool from among the plurality of first tools in a state in which the first tool retention member is engaged in an engagement hole of the last tool, the last tool being in contact with the second tool, retaining, by the second tool retention member, the second tool in a state in which the second tool retention member is engaged in the engagement hole of the second tool, subsequently moving the first tool exchange unit in the left-right direction by a predetermined amount in a state in which the movement of the second tool exchange unit in the left-right direction is stopped, thereafter retaining, by the first tool retention member, a leading tool from among the plurality of first tools in a state in which the first tool retention member is engaged in an engagement hole of the leading tool, retaining, by the second tool retention member, the last tool in a state in which the second tool retention member is engaged in the engagement hole of the last tool, and then moving the first tool exchange unit and the second tool exchange unit in the left-right direction.

The tool transport method described above may include, before retaining the last tool by the first tool retention member, retaining, by the first tool retention member, the leading tool in a state in which the first tool retention member is engaged in the engagement hole of the leading tool, retaining, by the second tool retention member, the last tool in a state in which the second tool retention member is engaged in the engagement hole of the last tool, and subsequently moving the first tool exchange unit in the left-right direction by a predetermined amount in a state in which the movement of the second tool exchange unit in the left-right direction is stopped.

The entire contents of Japanese Patent Application No. 2019-092890 (application date: May 16, 2019) are incorporated herein.

The invention claimed is:

1. A bending system comprising:

a tool storage placed in a vicinity of a press brake and including a plurality of stockers extending in a left-right direction, each stocker of the plurality of stockers configured so as to be able to retain a respective plurality of tools;

a first tool exchange unit and a second tool exchange unit each disposed on a table of the press brake so as to be movable in the left-right direction and configured to exchange a tool with respect to a tool holder of the press brake and a stocker selected from among the plurality of stockers;

a first left-right moving unit configured to move the first tool exchange unit in the left-right direction;

a second left-right moving unit configured to move the second tool exchange unit in the left-right direction; and a control unit configured to control the first tool exchange unit, the second tool exchange unit, the first left-right moving unit, and the second left-right moving unit, wherein the first tool exchange unit includes a first tool retention member engageable—with and disengageable—from an engagement hole of any one of the tools, the first tool retention member being able to retain any one of the tools and configured to move in the left-right direction together with the first tool exchange unit, the second tool exchange unit includes a second tool retention member engageable—with and disengageable—from an engagement hole of any one of the tools, the second tool retention member being able to retain any one of the tools and configured to move in the left-right direction together with the second tool exchange unit, and the control unit, when a first tool is a tool to be exchanged and is in contact with a second tool, which second tool is adjacent to the first tool and is not to be exchanged in the tool holder or the selected stocker, controls the first tool exchange unit, the second tool exchange unit, and the left-right moving units such that while the first tool retention member retains the first tool in a state in which the first tool retention member is engaged in the engagement hole of the first tool, and while the second tool retention member retains the second tool in a state in which the second tool retention member is engaged in the engagement hole of the second tool, the first tool exchange unit moves in the left-right direction in a state in which a movement of the second tool exchange unit in the left-right direction is stopped.

2. The bending system according to claim 1, wherein the first tool is also adjacent to and in contact with a third tool, and wherein the control unit controls the first tool exchange unit, the second tool exchange unit, and the left-right moving units such that:

the moving of the first tool exchange unit in the left-right direction in the state in which the first tool retention member is engaged in the engagement hole of the first tool and in which the movement of the second tool exchange unit in the left-right direction is stopped also moves the first and third tools in the left-right direction by a predetermined amount, the first tool retention member thereafter retains the third tool in a state in which the first tool retention member is engaged in an engagement hole of the third tool while the second tool retention member retains the first tool in a state in which the second tool retention member is engaged in the engagement hole of the first tool, and the first tool exchange unit and the second tool exchange unit then move in the left-right direction.

3. The bending system according to claim 1, wherein the first tool is also adjacent to and in contact with a third tool, and wherein the control unit, before the first tool retention member retains the first tool, controls the first tool exchange unit, the second tool exchange unit, and the left-right moving units such that while the first tool retention member retains the third tool in a state in which the first tool retention member is engaged in an engagement hole of the third tool, and while the second tool retention member retains the first tool in a state in which the second tool retention member is engaged in the engagement hole of the first tool, the first tool exchange unit moves in the left-right direction by a predetermined amount in a state in which the movement of the second tool exchange unit in the left-right direction is stopped.

4. A tool transport method using a first tool exchange unit and a second tool exchange unit each disposed on a table of a press brake so as to be movable in a left-right direction, the tool transport method comprising, when a first tool to be exchanged is in contact with an adjacent second tool that is not to be exchanged and that is in a tool holder of the press brake or in a selected stocker in a tool storage placed in a vicinity of the press brake:

while retaining, by a first tool retention member of the first tool exchange unit, the first tool in a state in which the first tool retention member is engaged in an engagement hole of the first tool, and while retaining, by a second tool retention member of the second tool exchange unit, the second tool in a state in which the second tool retention member is engaged in an engagement hole of the second tool, moving the first tool exchange unit in the left-right direction in a state in which a movement of the second tool exchange unit in the left-right direction is stopped.

5. The tool transport method according to claim 4, wherein the first tool is also adjacent to and in contact with a third tool, and wherein the moving of the first tool exchange unit in the left-right direction in the state in which the first tool retention member is engaged in the engagement hole of the first tool and in which the movement of the second tool exchange unit in the left-right direction is stopped also moves the first and third tools in the left-right direction by a predetermined amount, the method further comprising:

thereafter retaining, by the first tool retention member, the third tool in a state in which the first tool retention member is engaged in an engagement hole of the third tool while retaining, by the second tool retention member, the first tool in a state in which the second tool retention member is engaged in the engagement hole of the first tool; and then moving the first tool exchange unit and the second tool exchange unit in the left-right direction.

6. The tool transport method according to claim 4, wherein the first tool is also adjacent to and in contact with a third tool, the method further comprising, before retaining the first tool by the first tool retention member:

while retaining, by the first tool retention member, the third tool in a state in which the first tool retention member is engaged in an engagement hole of the third tool, and while retaining, by the second tool retention member, the first tool in a state in which the second tool retention member is engaged in the engagement hole of the first tool, moving the first tool exchange unit in the left-right direction by a predetermined amount in a state in which the movement of the second tool exchange unit in the left-right direction is stopped.

* * * * *